US007686182B1

(12) United States Patent
Shukri

(10) Patent No.: US 7,686,182 B1
(45) Date of Patent: Mar. 30, 2010

(54) BOTTLE CAP FOR BEVERAGE AND FOODSTUFF CONTAINERS

(76) Inventor: Rashed Shukri, 6614 Northampton Ct., Harrisburg, PA (US) 17111

( * ) Notice: Subject to any disclaimer, the term of this patent is extended or adjusted under 35 U.S.C. 154(b) by 1259 days.

(21) Appl. No.: 11/127,925

(22) Filed: May 13, 2005

(51) Int. Cl.
*A47G 19/22* (2006.01)

(52) U.S. Cl. ..... 220/711; 220/713; 220/715; 215/387

(58) Field of Classification Search ..... 220/713, 220/715, 711; 215/387
See application file for complete search history.

(56) References Cited

U.S. PATENT DOCUMENTS

| | | | | | |
|---|---|---|---|---|---|
| 3,015,411 | A | * | 1/1962 | Smith | 220/714 |
| 3,392,859 | A | | 7/1968 | Fischer | |
| 3,410,436 | A | * | 11/1968 | Foss et al. | 215/253 |
| 3,927,794 | A | * | 12/1975 | Erdman | 220/268 |
| 3,952,914 | A | * | 4/1976 | Vogt | 220/825 |
| 4,106,652 | A | | 8/1978 | Leclabart | |
| 4,113,135 | A | * | 9/1978 | Yamazaki | 220/268 |
| 4,138,033 | A | * | 2/1979 | Payne et al. | 220/254.3 |
| 4,184,604 | A | * | 1/1980 | Amberg et al. | 220/254.3 |
| 4,190,174 | A | * | 2/1980 | Haimowitz | 220/254.6 |
| 4,245,752 | A | * | 1/1981 | Prueher | 220/266 |
| 5,007,546 | A | | 4/1991 | Rose et al. | |
| 5,050,758 | A | * | 9/1991 | Freeman et al. | 220/714 |
| 5,104,008 | A | | 4/1992 | Crisci | |
| 5,706,972 | A | * | 1/1998 | Sousa | 220/714 |
| 5,894,950 | A | * | 4/1999 | Kick | 220/268 |
| 5,979,689 | A | * | 11/1999 | Lansky | 220/255 |
| 5,992,658 | A | * | 11/1999 | Berger | 215/232 |
| 6,050,435 | A | * | 4/2000 | Bush et al. | 215/250 |
| 6,062,419 | A | * | 5/2000 | Kruger et al. | 220/711 |
| 6,123,122 | A | * | 9/2000 | Dushman | 141/348 |
| D448,667 | S | | 10/2001 | Warner et al. | |
| 6,408,904 | B1 | * | 6/2002 | Dushman | 141/352 |
| 6,612,456 | B1 | * | 9/2003 | Hundley et al. | 220/254.3 |
| 6,921,003 | B2 | * | 7/2005 | Yu | 222/185.1 |

* cited by examiner

*Primary Examiner*—Anthony Stashick
*Assistant Examiner*—Christopher B McKinley

(57) ABSTRACT

A body has a threaded inner surface removably engageable with an open end portion of a beverage bottle. A lid is directly conjoined to the body and is offset below a top surface of the body for minimizing accidental contact therewith during non-use conditions. A mechanism for detaching the lid from the body is included in such a manner that a first perimeter portion of the lid becomes disengaged from an inner perimeter of the aperture while a second perimeter portion of the lid remains directly affixed to the inner perimeter of the aperture and thereby defines a linear fulcrum axis about which the lid can be repeatedly articulated during operating conditions. The lid is selectively articulated thereafter by placing a user's lips against the detaching mechanism so that the user may quickly and readily pivot the detaching mechanism without using the user's hands.

12 Claims, 4 Drawing Sheets

BOTTLE CAP FOR BEVERAGE AND FOODSTUFF CONTAINERS

CROSS REFERENCE TO RELATED APPLICATIONS

Not Applicable.

STATEMENT REGARDING FEDERALLY SPONSORED RESEARCH OR DEVELOPMENT

Not Applicable.

REFERENCE TO A MICROFICHE APPENDIX

Not Applicable.

BACKGROUND OF THE INVENTION

1. Technical Field

This invention relates to container closure assemblies and, more particularly, to a resiliently operable bottle cap for beverage and foodstuff containers.

2. Prior Art

It is highly desirable to provide a container with a closure capable of being easily opened and closed without the use of a tool particularly when it is necessary to maintain the integrity of the contents of the container and protect such contents from contaminants. Thus, the closure should be sufficiently closable to avoid contamination of the contents after the opening of the container.

Heretofore, it has been difficult to accomplish the foregoing, especially with both plastic and metal closures, suitable for plastic containers and metal cans, respectively. It is clearly advantageous to utilize a closure as aforesaid, usually made of the same material as the container, but also with other combinations, e.g., a plastic closure for a metal can. For greater convenience in recycling, the closure and container materials should be the same.

It is also desirable to provide a container closure assembly as aforesaid which is easy to prepare commercially and which is convenient and easy to use. Such containers are particularly useful for fluid products which are dispensed by pouring. Users of such containers have found it convenient to have a pour spout associated with the container to prevent dripping or unintentional spilling of the contents during pouring.

Consumers familiar with containers having pour spouts for fluid products, especially foods such as ketchup, salad dressing or the like products which congeal upon exposure to open air, will appreciate that the pour spout must be totally enclosed in an air-free environment when not in use. Squeeze bottles or the like having a snorkel-like pouring nozzle have been provided with end caps which fit over the free end of the nozzle and which are secured to the base of the nozzle with plastic banding integrally formed therewith. However, considerable care must be exercised in aligning the end cap with the nozzle. Also, the interconnecting band or strap is fragile and susceptible to tearing, with a potential loss of the end cap closure.

Other nozzles, such as those used with mustard containers, have closure arrangements located internal to the nozzle at points remote from the pouring tip thereof. However, after a dispensing operation is completed, the tip of the nozzle remains filled with the product, being trapped in the nozzle, above the closure elements. Over time, upon exposure to the outside air, the product trapped in the tip of the nozzle will spoil, congeal or otherwise present an unsatisfactory condition to the consumer. Accordingly, it is desirable to eliminate such trapping of product in the spout and to provide a total enclosure of the spout, preventing its contact with the outside air.

Accordingly, a need remains for a closeable container that overcomes the above-noted shortcomings. The present invention satisfies such a need by providing a resiliently operable bottle cap for beverage and foodstuff containers. Such a bottle cap is durable, lightweight, and easily installed and removed. The present invention offers individuals an effective way to prevent beverage spills that frequently stain clothing, furniture, carpet, rugs, the interior of automobiles, etc., and generally make a mess that must be cleaned. Such an invention preserves beverages and food products while maintaining their freshness, reducing waste, and saving a user time and money.

BRIEF SUMMARY OF THE INVENTION

In view of the foregoing background, it is therefore an object of the present invention to provide a resiliently operable bottle cap for water bottles and the like. These and other objects, features, and advantages of the invention are provided by a body having a threaded inner surface removably engageable with an open end portion of a beverage bottle. Such a body further has a monolithically formed top surface provided with an aperture centrally formed therein and axially aligned with a longitudinal axis passing through the bottle. A lid is directly conjoined to the body and positioned over the aperture for preventing foreign objects from entering the bottle and is offset below a top surface of the body for minimizing accidental contact therewith during non-use conditions.

The apparatus further includes a mechanism for detaching the lid from the body in such a manner that a first perimeter portion of the lid becomes disengaged from an inner perimeter of the aperture while a second perimeter portion of the lid remains directly affixed to the inner perimeter of the aperture and thereby defines a linear fulcrum axis about which the lid can be repeatedly articulated during operating conditions. Such a fulcrum axis is orthogonally offset from the longitudinal axis. A non-corrosive gasket directly lines the inner perimeter of the aperture so that fluids cannot seep between the gasket and the inner perimeter of the aperture. Such a gasket is permanently affixed to the aperture in such a manner that the lid selectively and directly engages the gasket after the lid is detached from the body.

Such a detaching mechanism is initially disengaged from the body by exerting a downwardly directed force towards the lid. The lid is selectively articulated thereafter by placing a user's lips against the detaching mechanism so that the user may quickly and readily pivot the detaching mechanism without using the user's hands. The lid and the gasket are detachably engageable subjacent the inner perimeter of the aperture.

The detaching mechanism includes an actuator arm directly and monolithically formed with the lid and protruding upwardly therefrom wherein the arm terminates at a predetermined height above the top surface of the body. The actuator arm has monolithically formed first and second portions directly conjoined to the top surface of the body and the lid respectively and further has a notch formed adjacent to the fulcrum axis and extending across a width of the aperture for assisting the user to readily articulate the second portion between raised and lowered positions defined above and below the aperture respectively. An outer edge of the lid is directly engageable with the gasket when the arm is retracted to the raised position. Such a raised position is defined along a horizontal plane.

A deformably resilient spring member having opposed end portions is directly connected to the arm and situated subjacent the top surface. Such a spring member is selectively adaptable between compressed and equilibrium positions in such a manner that the arm automatically returns to the raised position after the user articulates the arm to the lowered position. The arm is preferably sized and shaped for resting on a user's upper lip in such a manner that the user can articulate the lid to the lowered position by pressing the upper lip downwardly against the arm.

The apparatus preferably further includes a rubber washer directly intercalated between the top surface of the body and the open top end portion of the bottle. Such a washer maintains the body spaced above the top end portion of the bottle and permits the bottle cap to maintain a fluid-tight seal directly therewith.

It is noted the purpose of the foregoing abstract is to enable the U.S. Patent and Trademark Office and the public generally, especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

BRIEF DESCRIPTION OF THE SEVERAL VIEWS OF THE DRAWING

The novel features believed to be characteristic of this invention are set forth with particularity in the appended claims. The invention itself, however, both as to its organization and method of operation, together with further objects and advantages thereof, may best be understood by reference to the following description taken in connection with the accompanying drawings in which:

DETAILED DESCRIPTION OF THE INVENTION

Figure 1:
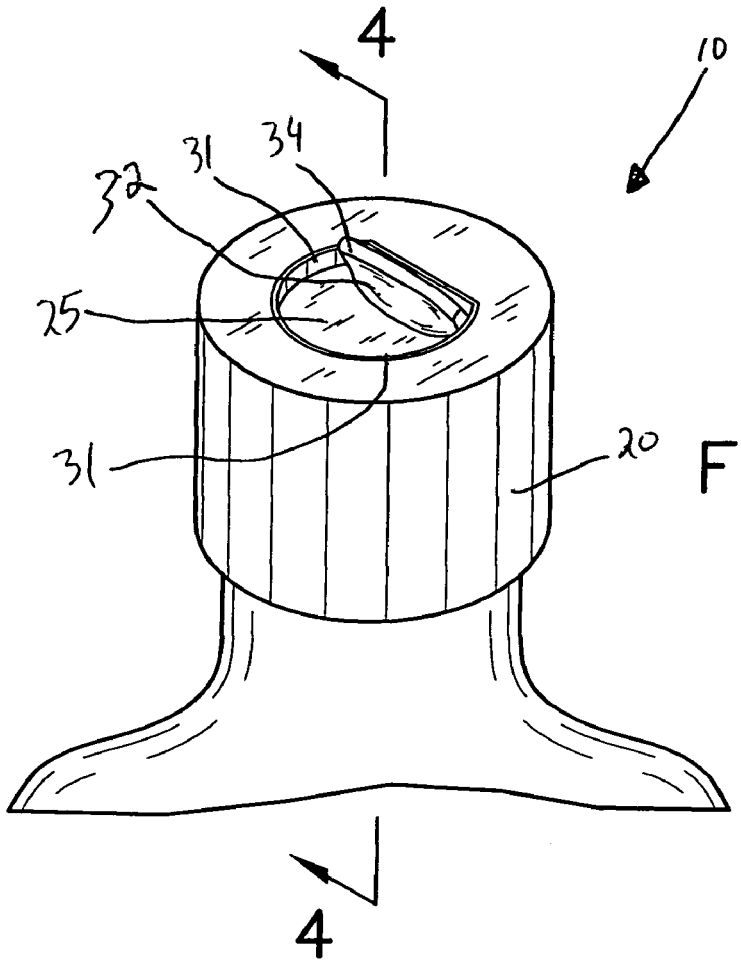
FIG. 1 is a perspective view showing a resiliently operable bottle cap, in accordance with the present invention.

The present invention will now be described more fully hereinafter with reference to the accompanying drawings, in which a preferred embodiment of the invention is shown. This invention may, however, be embodied in many different forms and should not be construed as limited to the embodiment set forth herein. Rather, this embodiment is provided so that this application will be thorough and complete, and will fully convey the true scope of the invention to those skilled in the art. Like numbers refer to like elements throughout the figures.

The apparatus of this invention is referred to generally in FIGS. 1-6 by the reference numeral 10 and is intended to provide a resiliently operable bottle cap for water bottles and the like. It should be understood that the apparatus 10 may be used to cap many different types of containers and should not be limited to only water bottles.

Figure 2:
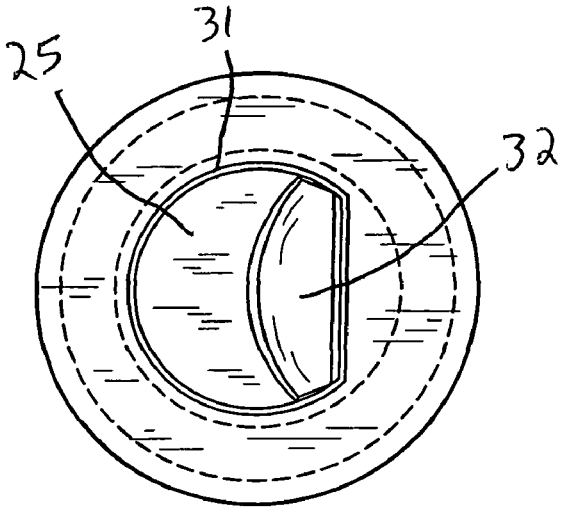
FIG. 2 is a top plan view showing the arm at a raised position.
Figure 3:
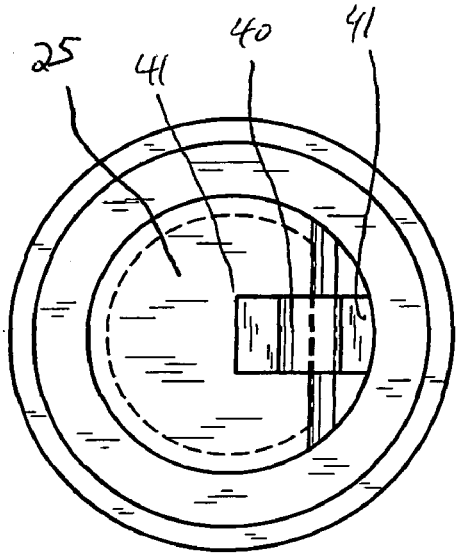
FIG. 3 is a bottom plan view of the present invention shown in FIG. 2.

Initially referring to FIGS. 1, and 4-6, the apparatus 10 includes a body 20 having a threaded inner surface 21 removably engageable with an open end portion 22 of a beverage bottle. Such a threaded inner surface 21 enables a user to easily remove the apparatus 10 in order to refill or replenish a water bottle or other container. Such a body 20 further has a monolithically formed top surface 23 provided with an aperture 24 centrally formed therein and axially aligned with a longitudinal axis (not shown) passing through the bottle, as shown in FIGS. 2 and 3. A lid 25 is directly conjoined to the body 20 and positioned over the aperture 24 for preventing foreign objects from entering the bottle and is offset below a top surface 23 of the body 20 for minimizing accidental contact therewith during non-use conditions. Such a lid 25 conveniently keeps flies and other insects out that may be attracted to the contents of the bottle.

Figure 4:
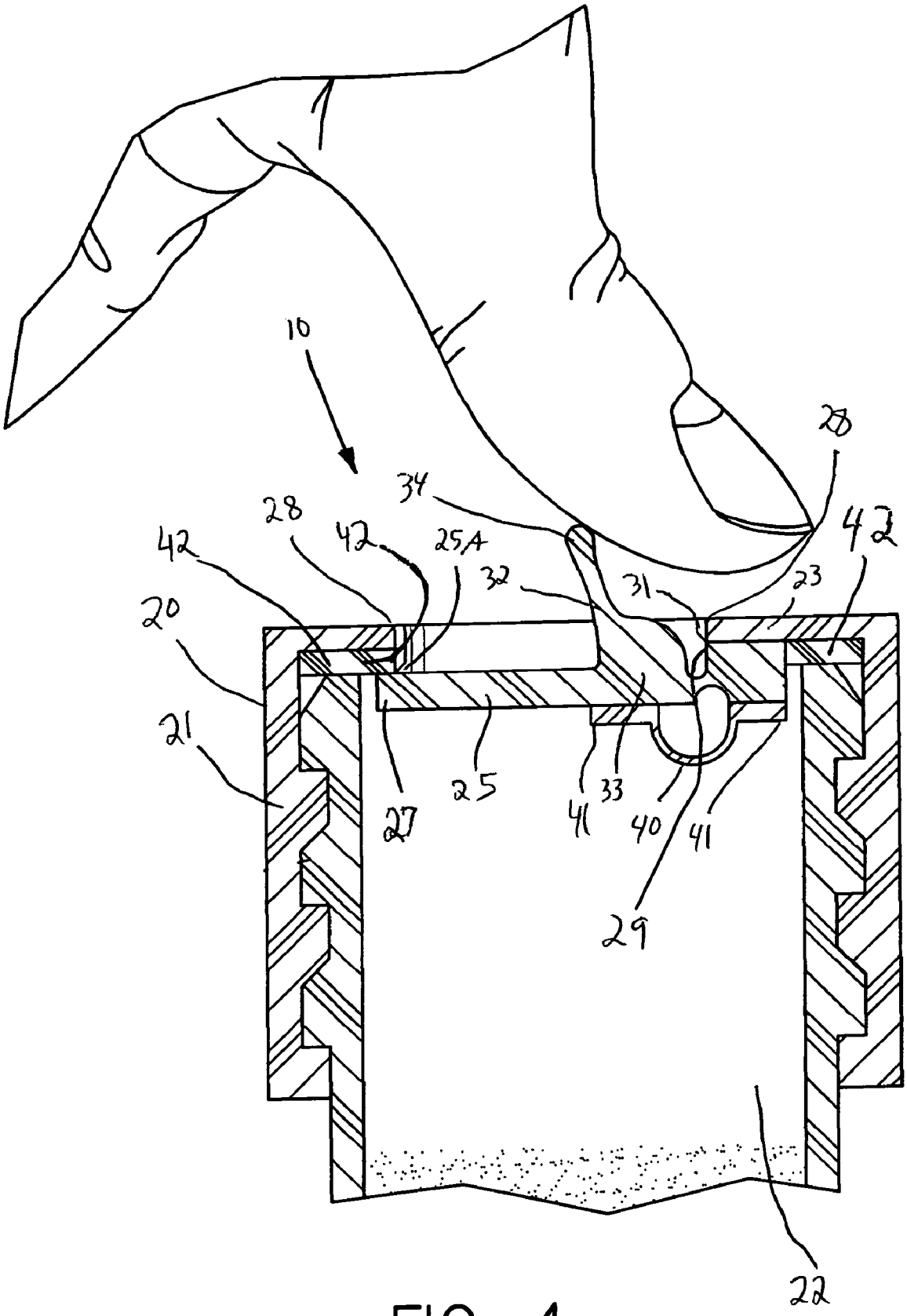
FIG. 4 is an enlarged cross-sectional view of the apparatus shown in FIG. 1, taken along line 4-4 and illustrating the arm at a raised position.
Figure 5:
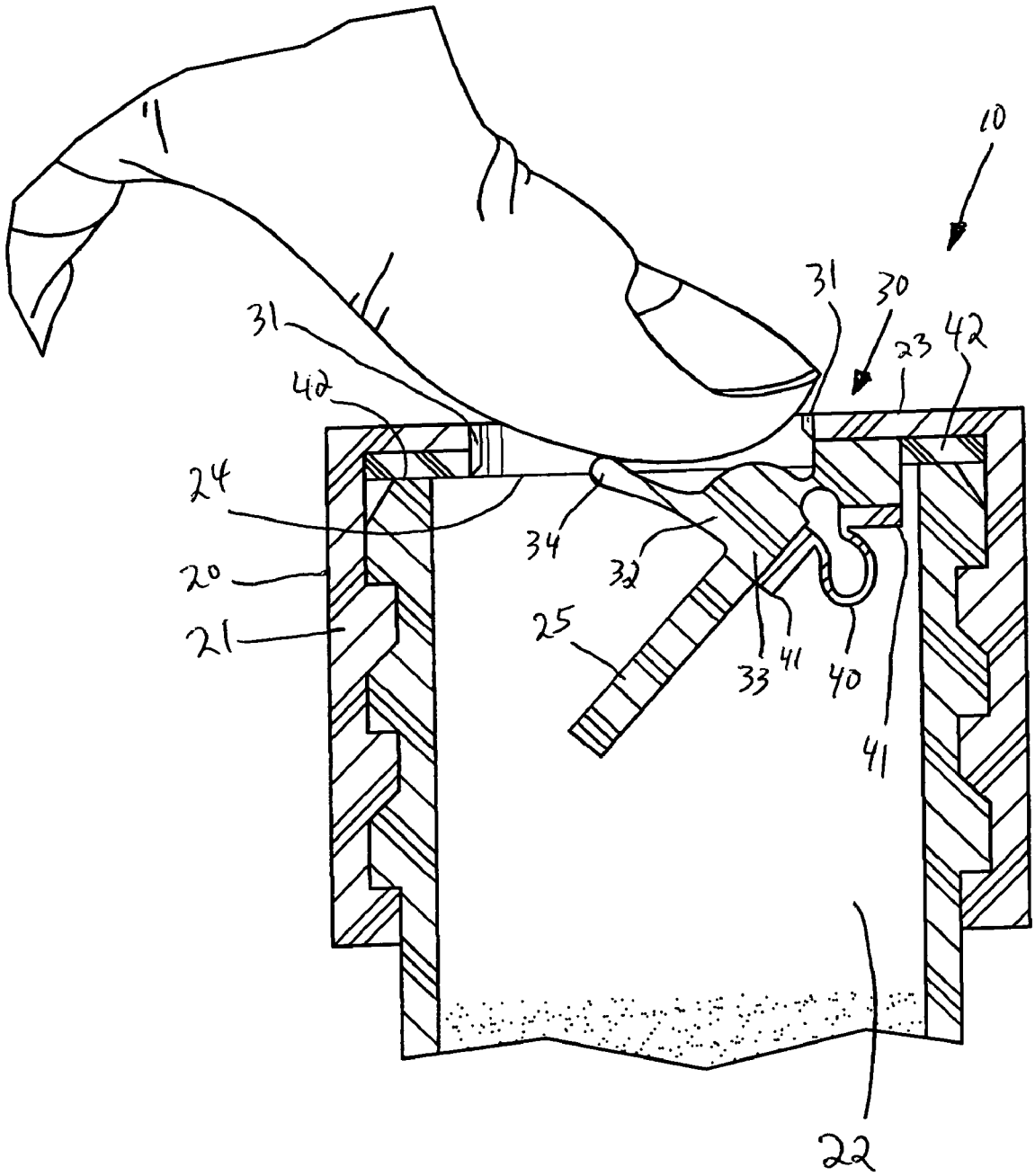
FIG. 5 is a cross-sectional view of the apparatus shown in FIG. 4, illustrating the arm at a lowered position.
Figure 6:
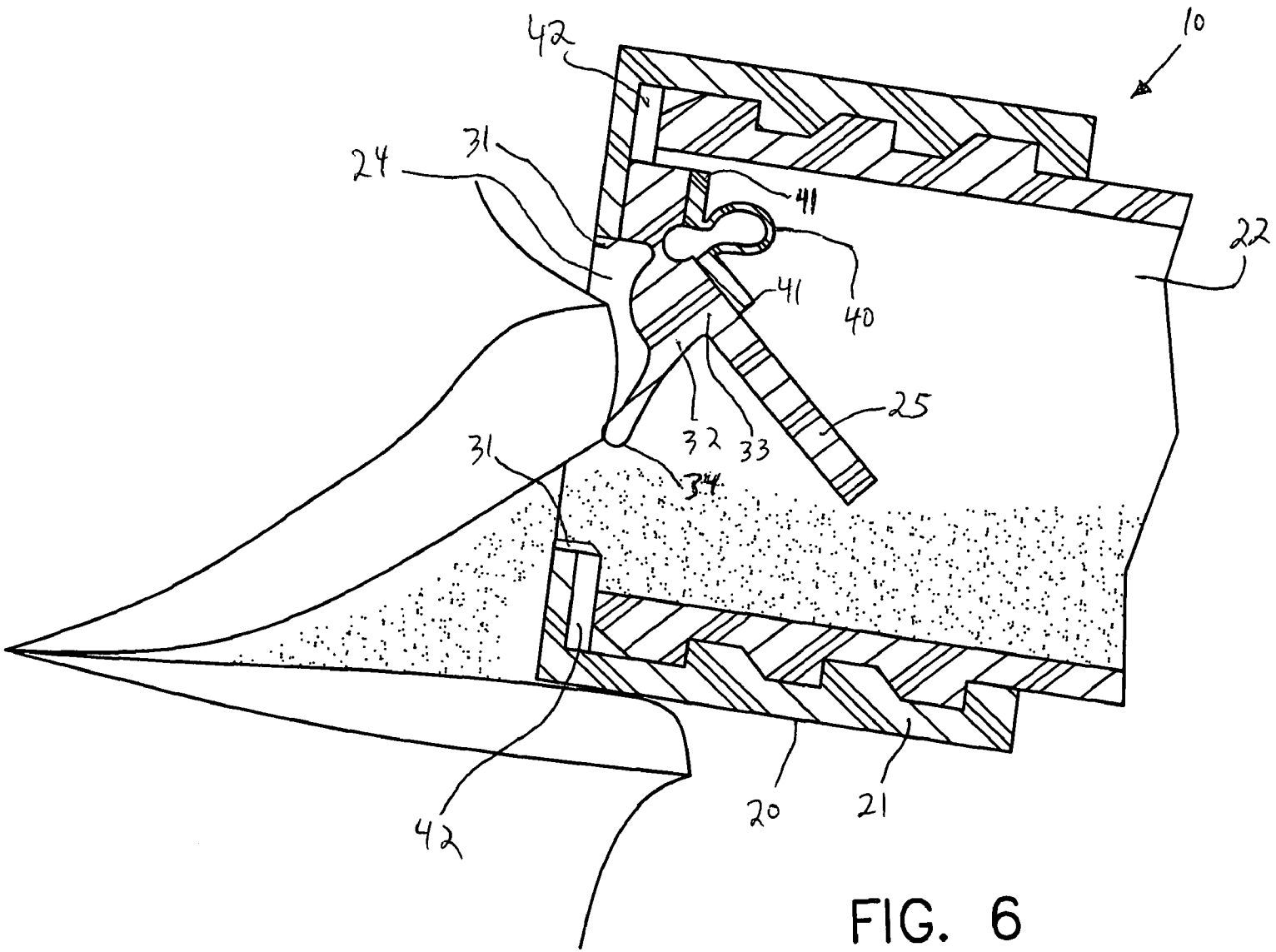
FIG. 6 is an enlarged cross-sectional view of the apparatus shown in FIG. 5, illustrating the placing of a user's lips against the detaching mechanism.

Still referring to FIGS. 4-6, the apparatus 10 further includes a mechanism 30 for detaching the lid 25 from the body 20 in such a manner that a first perimeter portion 27 of the lid 25 becomes disengaged from an inner perimeter 28 of the aperture 24 while a second perimeter portion 29 of the lid 25 remains directly affixed to the inner perimeter 28 of the aperture 24 and thereby defines a linear fulcrum axis about which the lid 25 can be repeatedly articulated during operating conditions, thereby enabling a user to use the bottle and apparatus 10 many times, reducing costs and the necessity to store a large quantity of bottles.

Such a fulcrum axis is orthogonally offset from the longitudinal axis. A gasket 31 formed from non-corrosive material directly lines the inner perimeter 28 of the aperture 24 so that fluids cannot seep between the gasket 31 and the inner perimeter 28 of the aperture 24. Such a gasket 31 is permanently affixed to the aperture 24 in such a manner that the lid 25 selectively and directly engages the gasket 31 after the lid 25 is detached from the body 20. The gasket 31 is preferably formed from non-toxic material so that it is compatible for use with beverage containers.

Again referring to FIGS. 4-6, such a detaching mechanism 30 is initially disengaged from the body 20 by exerting a downwardly directed force towards the lid 25. The lid 25 is selectively articulated thereafter by placing a user's lips against the detaching mechanism 30 so that the user may quickly and readily pivot the detaching mechanism 30 without using the user's hands, as shown in FIG. 6. This allows individuals to open the apparatus 10 without using their hands and also prevents spills and wastage of drinks. By pushing the arm (described herein below) downward with their lips, users could easily sip beverage from the bottle. Releasing such an arm would seal the container and avoid spills, particularly during transportation. This allows individuals to more easily sip the contents while driving, biking, exercising, etc. The lid 25 and the gasket 31 are detachably engageable subjacent the inner perimeter 28 of the aperture 24.

Still referring to FIGS. 4-6, the detaching mechanism 30 includes an actuator arm 32 directly and monolithically formed with the lid 25 and protruding upwardly therefrom wherein the arm 32 terminates at a predetermined height above the top surface 23 of the body 20. The actuator arm 32 has monolithically formed first 33 and second 34 portions directly conjoined with no intervening elements to the top surface 23 of the body 20 and the lid 25 respectively and further has a notch 35 formed adjacent to the fulcrum axis and extending across a width of the aperture 24 for assisting the user to readily articulate the second portion 34 between raised and lowered positions defined above and below the aperture 24 respectively. An outer edge 25A of the lid 25 is directly engageable with the gasket 31 when the arm 32 is retracted to the raised position. Such a raised position is defined along a horizontal plane.

Still referring to FIGS. 4-6, a deformably resilient spring member 40 having opposed end portions 41 is directly connected with no intervening elements to the arm 32 and situated subjacent the top surface 23. Such a spring member 40 is selectively adaptable between compressed and equilibrium positions in such a manner that the arm 32 automatically returns to the raised position after the user articulates the arm 32 to the lowered position. The arm 32 is preferably sized and shaped for resting on a user's upper lip in such a manner that the user can articulate the lid 25 to the lowered position by pressing the upper lip downwardly against the arm 32. As a result, no hands would be necessary to open the apparatus 10 and such an apparatus 10 would be immediately closed when a user's lips are withdrawn. The apparatus 10 preferably further includes a rubber washer 42 directly intercalated with no intervening elements between the top surface 23 of the body 20 and the open top end portion 22 of the bottle. Such a washer 42 maintains the body 20 spaced above the top end portion 22 of the bottle and permits the bottle cap to maintain a fluid-tight seal directly therewith.

The apparatus 10 keeps contents fresh and carbonated for a longer period of time, as well as preventing insects from contaminating the contents thereof. With the apparatus 10, a user could consume a portion of the contents, and then reseal the container and consume the remainder of the contents at a later time. Carbonated drinks contained within such a bottle would remain carbonated and retain the fresh taste of a first sip. Such an apparatus 10 is ideal for outdoor parties, picnics, tailgate parties, camping, and for use on trips.

While the invention has been described with respect to a certain specific embodiment, it will be appreciated that many modifications and changes may be made by those skilled in the art without departing from the spirit of the invention. It is intended, therefore, by the appended claims to cover all such modifications and changes as fall within the true spirit and scope of the invention.

In particular, with respect to the above description, it is to be realized that the optimum dimensional relationships for the parts of the present invention may include variations in size, materials, shape, form, function and manner of operation. The assembly and use of the present invention are deemed readily apparent and obvious to one skilled in the art.

What is claimed as new and what is desired to secure by Letters Patent of the United States is:

1. A resiliently operable bottle cap for water bottles and the like, said bottle cap comprising:

a body having a threaded inner surface removably engageable with an open end portion of a beverage bottle, said body further having a monolithically formed top surface provided with an aperture centrally formed therein and axially aligned with a longitudinal axis passing through the bottle;

a lid directly conjoined to said body and positioned over the aperture for preventing foreign objects from entering the bottle, said lid being offset below a top surface of said body for minimizing accidental contact therewith during non-use conditions;

means for detaching said lid from said body in such a manner that a first perimeter portion of said lid becomes disengaged from an inner perimeter of the aperture while a second perimeter portion of said lid remains directly affixed to the inner perimeter of the aperture and thereby defines a linear fulcrum axis about which said lid can be repeatedly articulated during operating conditions; and a gasket formed from non-corrosive material directly lines the inner perimeter of the aperture so that fluids cannot seep between said gasket and the inner perimeter of the aperture, said gasket being permanently affixed to the aperture in such a manner that said lid selectively and directly engages said gasket after said lid is detached from said body;

wherein said detaching means is initially disengaged from said body by exerting a downwardly directed force towards said lid, said lid thereafter being selectively articulated by placing a user's lips against said detaching means so that the user may quickly and readily pivot said detaching means without using the user's hands;

wherein said detaching means comprises an actuator arm directly and monolithically formed with said lid and protruding upwardly therefrom wherein said arm terminates at a predetermined height above said top surface of said body, said actuator arm having monolithically formed first and second portions directly conjoined to said top surface of said body and said lid respectively, said arm further having a notch formed adjacent the fulcrum axis and extending across a width of the aperture for assisting the user to readily articulate said second portion between raised and lowered positions defined above and below the aperture respectively; and a deformably resilient spring member having opposed end portions directly connected to said arm and situated subjacent said top surface, said spring member being selectively adaptable between compressed and equilibrium positions in such a manner that said arm automatically returns to the raised position after the user articulates said arm to the lowered position.

2. The bottle cap of claim 1, further comprising: a rubber washer directly intercalated between said top surface of said body and the open top end portion of the bottle, said washer maintaining said body spaced above the top end portion of the bottle and permitting said bottle cap to maintain a fluid-tight seal directly therewith.

3. The bottle cap of claim 2, wherein an outer edge of said lid is directly engageable with said gasket when said arm is retracted to the raised position, the raised position being defined along a horizontal plane.

4. The bottle cap of claim 3, wherein said arm is sized and shaped for resting on a user's upper lip in such a manner that the user can articulate said lid to the lowered position by pressing the upper lip downwardly against said arm.

5. A resiliently operable bottle cap for water bottles and the like, said bottle cap comprising:

a body having a threaded inner surface removably engageable with an open end portion of a beverage bottle, said body further having a monolithically formed top surface provided with an aperture centrally formed therein and axially aligned with a longitudinal axis passing through the bottle;

a lid directly conjoined to said body and positioned over the aperture for preventing foreign objects from entering the bottle, said lid being offset below a top surface of said body for minimizing accidental contact therewith during non-use conditions;

means for detaching said lid from said body in such a manner that a first perimeter portion of said lid becomes disengaged from an inner perimeter of the aperture while a second perimeter portion of said lid remains directly affixed to the inner perimeter of the aperture and thereby defines a linear fulcrum axis about which said lid can be repeatedly articulated during operating conditions;

wherein the fulcrum axis is orthogonally offset from the longitudinal axis; and a gasket formed from non-corrosive material directly lines the inner perimeter of the aperture so that fluids cannot seep between said gasket and the inner perimeter of the aperture, said gasket being permanently affixed to the aperture in such a manner that said lid selectively and directly engages said gasket after said lid is detached from said body;

wherein said detaching means is initially disengaged from said body by exerting a downwardly directed force towards said lid, said lid thereafter being selectively articulated by placing a user's lips against said detaching means so that the user may quickly and readily pivot said detaching means without using the user's hands;

wherein said detaching means comprises an actuator arm directly and monolithically formed with said lid and protruding upwardly therefrom wherein said arm terminates at a predetermined height above said top surface of said body, said actuator arm having monolithically formed first and second portions directly conjoined to said top surface of said body and said lid respectively, said arm further having a notch formed adjacent the fulcrum axis and extending across a width of the aperture for assisting the user to readily articulate said second portion between raised and lowered positions defined above and below the aperture respectively; and a deformably resilient spring member having opposed end portions directly connected to said arm and situated subjacent said top surface, said spring member being selectively adaptable between compressed and equilibrium positions in such a manner that said arm automatically returns to the raised position after the user articulates said arm to the lowered position.

6. The bottle cap of claim 5, further comprising: a rubber washer directly intercalated between said top surface of said body and the open top end portion of the bottle, said washer maintaining said body spaced above the top end portion of the bottle and permitting said bottle cap to maintain a fluid-tight seal directly therewith.

7. The bottle cap of claim 6, wherein an outer edge of said lid is directly engageable with said gasket when said arm is retracted to the raised position, the raised position being defined along a horizontal plane.

8. The bottle cap of claim 7, wherein said arm is sized and shaped for resting on a user's upper lip in such a manner that the user can articulate said lid to the lowered position by pressing the upper lip downwardly against said arm.

9. A resiliently operable bottle cap for water bottles and the like, said bottle cap comprising:

a body having a threaded inner surface removably engageable with an open end portion of a beverage bottle, said body further having a monolithically formed top surface provided with an aperture centrally formed therein and axially aligned with a longitudinal axis passing through the bottle;

a lid directly conjoined to said body and positioned over the aperture for preventing foreign objects from entering the bottle, said lid being offset below a top surface of said body for minimizing accidental contact therewith during non-use conditions;

means for detaching said lid from said body in such a manner that a first perimeter portion of said lid becomes disengaged from an inner perimeter of the aperture while a second perimeter portion of said lid remains directly affixed to the inner perimeter of the aperture and thereby defines a linear fulcrum axis about which said lid can be repeatedly articulated during operating conditions;

wherein the fulcrum axis is orthogonally offset from the longitudinal axis; and a gasket formed from non-corrosive material directly lines the inner perimeter of the aperture so that fluids cannot seep between said gasket and the inner perimeter of the aperture, said gasket being permanently affixed to the aperture in such a manner that said lid selectively and directly engages said gasket after said lid is detached from said body;

wherein said detaching means is initially disengaged from said body by exerting a downwardly directed force towards said lid, said lid thereafter being selectively articulated by placing a user's lips against said detaching means so that the user may quickly and readily pivot said detaching means without using the user's hands;

wherein said lid and said gasket are detachably engageable subjacent the inner perimeter of the aperture;

wherein said detaching means comprises an actuator arm directly and monolithically formed with said lid and protruding upwardly therefrom wherein said arm terminates at a predetermined height above said top surface of said body, said actuator arm having monolithically formed first and second portions directly conjoined to said top surface of said body and said lid respectively, said arm further having a notch formed adjacent the fulcrum axis and extending across a width of the aperture for assisting the user to readily articulate said second portion between raised and lowered positions defined above and below the aperture respectively; and a deformably resilient spring member having opposed end portions directly connected to said arm and situated subjacent said top surface, said spring member being selectively adaptable between compressed and equilibrium positions in such a manner that said arm automatically returns to the raised position after the user articulates said arm to the lowered position;

wherein said actuator is completely displaced subjacent to said top surface of said body and penetrates through said aperture when said lid is biased downwardly below said aperture.

10. The bottle cap of claim 9, further comprising: a rubber washer directly intercalated between said top surface of said body and the open top end portion of the bottle, said washer maintaining said body spaced above the top end portion of the bottle and permitting said bottle cap to maintain a fluid-tight seal directly therewith.

11. The bottle cap of claim 10, wherein an outer edge of said lid is directly engageable with said gasket when said arm is retracted to the raised position, the raised position being defined along a horizontal plane.

12. The bottle cap of claim 11, wherein said arm is sized and shaped for resting on a user's upper lip in such a manner that the user can articulate said lid to the lowered position by pressing the upper lip downwardly against said arm.

* * * * *